US011214460B2

(12) United States Patent
Lin

(10) Patent No.: US 11,214,460 B2
(45) **Date of Patent: *Jan. 4, 2022**

(54) CUTTING MACHINE HEAD AND CUTTING MACHINE THEREOF

(71) Applicant: Jingwei Systemtechnik Ltd., Ningbo (CN)

(72) Inventor: Lixue Lin, Ningbo (CN)

(73) Assignee: JINGWEI SYSTEMTECHNIK LTD., Ningbo (CN)

( * ) Notice: Subject to any disclaimer, the term of this patent is extended or adjusted under 35 U.S.C. 154(b) by 92 days.

This patent is subject to a terminal disclaimer.

(21) Appl. No.: 16/683,218

(22) Filed: Nov. 13, 2019

(65) Prior Publication Data

US 2021/0053789 A1 Feb. 25, 2021

(30) Foreign Application Priority Data

Aug. 20, 2019 (CN) ..... 201910769541.3

(51) Int. Cl.
*B65H 35/00* (2006.01)
*B26D 1/04* (2006.01)

(52) U.S. Cl.
CPC ..... *B65H 35/0086* (2013.01); *B26D 1/045* (2013.01); *B65H 35/002* (2013.01)

(58) Field of Classification Search
CPC ..... B26D 1/045; B26D 2007/2678; B26D 3/085; B26D 7/2614; B26D 7/2621; B26D 7/2628; B26D 7/2635; B26D 7/27; B26D 9/00; B26F 1/3813; B26F 1/3826; B31F 1/10; B43L 13/00; B43L 13/022; B65H 35/002; B65H 35/0086
See application file for complete search history.

(56) References Cited

U.S. PATENT DOCUMENTS 5,189,936 A * 3/1993 Gerber ..... B26D 7/018 198/851
5,655,859 A * 8/1997 Melzer ..... G06K 19/07745 409/132
5,791,216 A * 8/1998 Hada ..... B26D 5/005 83/13

FOREIGN PATENT DOCUMENTS

CN 201669918 U * 12/2010

* cited by examiner

*Primary Examiner* — Stephen Choi

(57) ABSTRACT

A cutting machine head and a cutting machine are provided in the present invention. The cutting machine head includes a fixing plate, a cutter holder, a cutting component, a machine head lifting mechanism and a machine head rotating mechanism. The cutter holder is mounted on the fixing plate. The machine head lifting mechanism is connected to the cutter holder, and is used to drive the cutter holder to move up and down on the fixing plate. The cutting component includes at least two cutter head assemblies mounted on the cutter holder. The machine head rotating mechanism is connected to the cutter head assemblies for driving the cutter head assemblies to rotate. The rotating angle of each cutter head assembly of the cutting machine head can be controlled. The machine head rotating mechanism controls the cutter head assembly to rotate when the machine head is cutting, and the resulting cutting line has no flaws, which can ensure the integrity of the cutting pattern.

18 Claims, 6 Drawing Sheets

CUTTING MACHINE HEAD AND CUTTING MACHINE THEREOF

BACKGROUND OF THE INVENTION

Field of the Invention

The present invention relates to the technical field of paper cutting equipment, in particular to a cutting machine head and a cutting machine thereof.

Description of Related Art

With the development of technology, the level of industrial automation continues to increase, and new paper cutting machines gradually replace traditional manual cutting methods. The paper cutting machine can cut a variety of papers such as craft paper, packaging cartons, book covers, stickers, etc., and has higher quality and processing efficiency than manual cutting.

The existing paper cutting machine completes cutting by cutting through the paper by the cutter head mounted on the machine head, wherein the cutter head is eccentrically mounted on the cutter seat, and the cutter head is rotatable relative to the cutter seat, so that the paper that is subjected to paper cutting processing has an extra cutting line at the beginning of the cutting line. The main reason is that at the beginning of the cutting, the electrical equipment controls the movement of the machine head, and the machine head is lowered to bring the cutter head into contact with the paper after moving to the cutting position, at which time however the angle at which the cutter head rotates remains to be an angle when the last cutting is completed, so that the angle is uncontrollable, then a force will be generated when the cutter head comes into contact with the paper, and the cutter head will automatically rotate to an appropriate angle to complete the cutting when the machine head moves. However, during the process of the cutter head rotating to the appropriate angle from when being in initial contact with the paper, the cutter head will cut the paper to leave extra traces, and in general to leave a small arc cutting line at the front end of the cutting line. That is, the cutting line of the existing paper cutting machine is flawed, and the integrity of the cutting pattern cannot be guaranteed.

SUMMARY OF THE INVENTION

In order to overcome the drawbacks of the prior art, it is an object of the present invention to provide a cutting machine head and a cutting machine thereof. The cutting machine head and the cutting machine of the present invention can overcome the problem of no unnecessary cutting lines are present during the cutting operation of the cutting machine head to ensure the integrity of the cutting pattern.

To overcome the above problems, a cutting machine head is provided in one embodiment of the present invention. The cutting machine includes a fixing plate, a cutter holder, a cutting component, a machine head lifting mechanism and a machine head rotating mechanism. The cutter holder is mounted on the fixing plate; the machine head lifting mechanism is connected to the cutter holder, and is used to drive the cutter holder to move up and down on the fixing plate; the cutting component comprises at least two cutter head assemblies mounted on the cutter holder; the machine head rotating mechanism is connected to the cutter head assemblies for driving the cutter head assemblies to rotate.

In one embodiment, the machine head rotating mechanism includes a rotating motor, a synchronizing belt, and a plurality of synchronizing gears; the cutter head assemblies include a plurality of rotating sleeves; each of the plurality of synchronizing gears are connected to each of the plurality of rotating sleeves; a motor shaft of the rotating motor is connected to one of the at least two cutter head assemblies; and the synchronizing belt connects each of the plurality of synchronizing gears.

In one embodiment, each of the cutter head assemblies includes a cutter head, a cutter handle and a positioning pin; the cutter head is mounted on the cutter handle; a positioning groove is disposed in a tail of the cutter handle; the positioning pin enters the positioning groove; and the positioning pin rotates synchronously with the corresponding rotating sleeve.

In one embodiment, an engagement slot is disposed on the cutter handle, and a sealing ring is engaged in the engagement slot.

In one embodiment, the cutting component includes a full-cutting cutter head assembly, a half-cutting cutter head assembly, and a pinch roller cutter head assembly; the full-cutting cutter head assembly includes a full-cutting cutter head; the half-cutting cutter head assembly includes a half-cutting cutter head; and the pinch roller cutter head assembly includes a pinch roller cutter head.

In one embodiment, the full-cutting cutter head assembly further includes a first air cylinder for controlling a lift movement of the full-cutting cutter head; and the half-cutting cutter head assembly further includes a second air cylinder for controlling a lift movement of the half-cutting cutter head.

In one embodiment, the pinch roller cutter head assembly further includes a connecting shaft, the motor shaft of the rotating motor is fixedly connected to the connecting shaft; when the rotating motor performs a rotation, the pinch roller cutter head assembly follows the rotation, and a third synchronizing gear of the pinch roller cutter head assembly rotates to move the synchronizing belt, thereby driving a first synchronizing gear of the full-cutting cutter head assembly and a second synchronizing gear of the half-cutting cutter head assembly to rotate.

In one embodiment, the machine head lift mechanism further includes a lifting motor, a screw rod and a lifting screw nut; a motor shaft of the lifting motor is connected to the screw rod, the lifting screw nut is mounted on the screw rod, and the lifting screw nut is connected to the cutter holder.

In one embodiment, the cutter holder is further provided with a marking assembly; the marking assembly includes a pen seat, a pen seat guiding rod, a marker pen, and a third air cylinder; the marker pen is mounted on the pen seat, the pen seat is connected to the pen seat guiding rod, the third air cylinder is connected to the pen seat for driving the pen seat to move up and down.

In one embodiment, the cutter holder is further provided with a positioning mechanism, and the positioning mechanism includes a positioning camera and a flashlight.

Compared with the prior art, the cutting machine head of the present invention has a plurality of cutter head assemblies. Each of the cutter head assemblies is controlled in the rotation angle by the machine head rotating mechanism, and each of the cutter head assemblies has a controllable rotation angle. When the machine head performs cutting, the cutter head assembly that needs to perform cutting operation is moved to an appropriate height by the machine head lifting mechanism, the cutter head assembly is controlled to rotate by the machine head rotating mechanism, and the angle of the cutter head assembly is adjusted at any time according to a defined cutting line. The cutting line cut by the machine head has no flaws and completely coincides with the defined cutting line to ensure the integrity of the cutting pattern.

In another embodiment of the present invention, a cutting machine having the cutting machine head above is provided. Compared with the prior art, the beneficial effects of the cutting machine of the present invention are the same as those of the cutting machine head described above, and further description is omitted herein.

BRIEF DESCRIPTION OF THE DRAWINGS

Aspects of the present invention are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DESCRIPTION OF THE INVENTION

Figure 1:
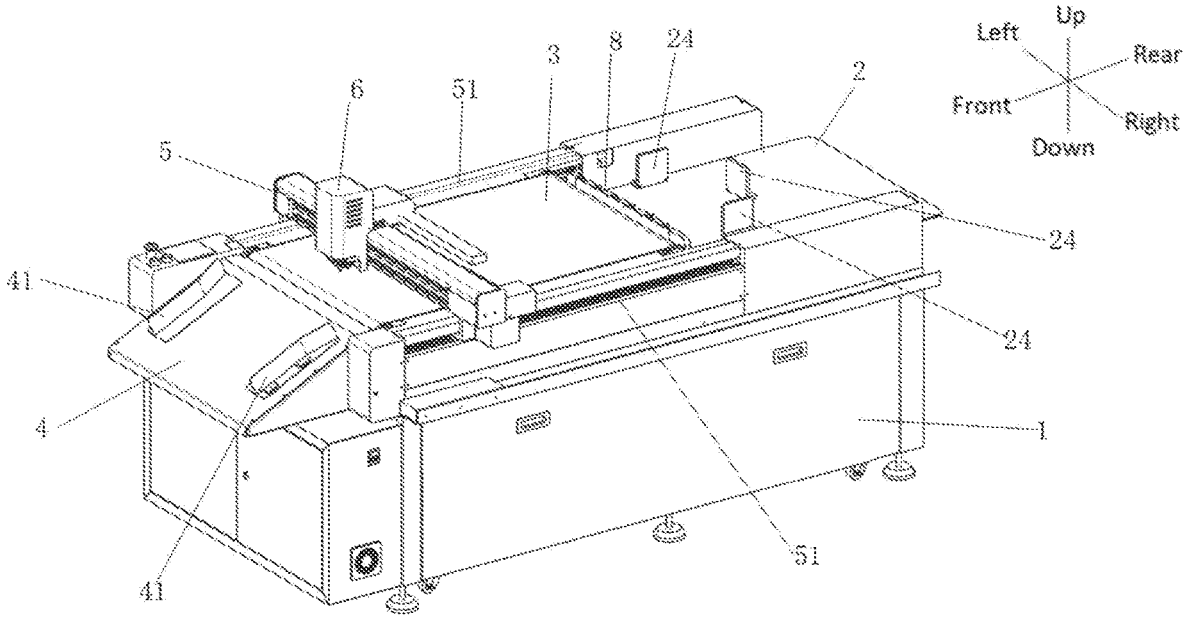
FIG. 1 is a first structural view of a paper feeding and cutting machine of the present invention.

The following invention provides many different embodiments, or examples, for implementing different features of the provided subject matter. Specific examples of components and arrangements are described below to simplify the present invention. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct iii contact. In addition, the present invention may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

As shown in combination of FIG. 1 through FIG. 13, the embodiment of the present invention provides a paper-feeding cutting machine, which is used for cutting paper boxes, book covers, stickers and other papers, may automatically complete the cutting work according to the user's requirements, and may provide paper cutting precision and production efficiency.

Figure 2:
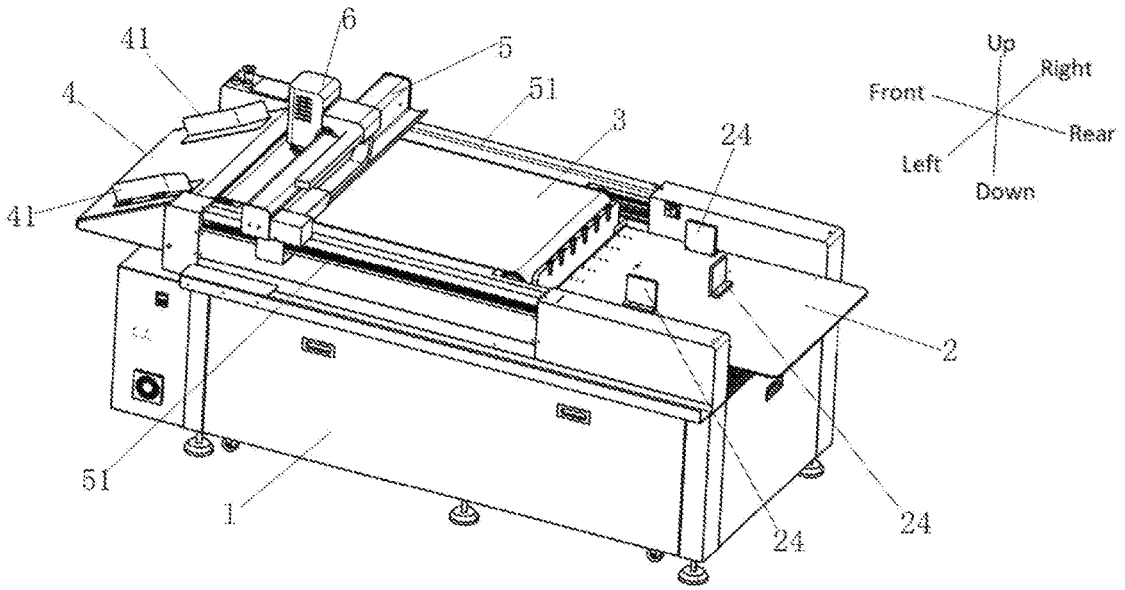
FIG. 2 is a second structural view of a paper feeding and cutting machine of the present invention.

As shown in combination of FIG. 1 through FIG. 2, the paper-feeding cutting machine includes a frame 1, wherein a control element of the paper-feeding cutting machine is mounted on the frame 1, and the frame 1 is provided with a paper-loading platform 2, a cutting table 3, a receiving hopper 4 and a crossbeam 5. The paper-loading platform 2 is used for placing the paper to be cut, the paper cutting work is completed on the cutting table 3, and the receiving hopper 4 is used to collect the cut paper. The crossbeam 5 may be moved back and forth. The crossbeam 5 is provided with a machine head 6, and the machine head 6 is provided with cutting components. The machine head 6 may be moved left and right along the crossbeam 5 to perform a cutting operation. The paper-feeding cutting machine is highly automated, so that the complete process of paper feeding, cutting and receiving may be automatically completed according to the setting, without manual operation.

The paper-loading platform 2 is provided with three feeding baffles 24, which are respectively used for limiting positions of the left, right, and back sides of the paper. The bottom of the feeding baffle 24 is magnetically connected to the paper-loading platform 2 such that the feeding baffle 24 may be arbitrarily moved on the paper-loading platform 2, and the limited position may be adjusted according to the paper size, which is convenient to operate and has good practical value. In other embodiments, the number of the feeding baffles 24 may be adjusted as needed, and increasing the number of the feed baffles 24 may make the limiting effect better. The bottom of the paper-loading platform 2 is provided with a platform lifting mechanism (not shown) for driving the paper-loading platform 2 to move up and down, and adjusting the height of the paper-loading platform 2. The platform lifting mechanism (not shown) automatically moves up and down according to the height of the paper to ensure that the paper on the paper-loading platform 2 may be sent to the cutting table 3.

The cutting table 3 includes rollers disposed on the front and rear sides and a conveyor belt wrapped on the rollers, wherein one of the rollers rotates to drive the conveyor belt to move, and the other roller follows the rotation, so that the conveyor belt moves to transfer the paper to the receiving hopper 4 after the paper is cut on the cutting table 3. In the prior art, the cutting table 3 is welded and fixed to the frame 1; the conveyor belt is assembled by wrapping a whole piece of felt or rubber around the rollers on both sides, and then bonding both ends of the felt or rubber together, wherein the bonding has to be completed on the frame 1, causing inconvenient operation, poor bonding effect, and uneven seam on the conveyor belt, which is easy to disengage from each other. However, the cutting table 3 of this embodiment is integrally mounted on the frame 1, and is fixedly connected to the frame 1 by screws, so as to be integrally removed. In this way, the conveyor belt may be bonded on an external processing platform, and then an annular conveyor belt is directly put on the roller to make the seam on the conveyor belt smoother, so that the connection effect is good, and the service life of the conveyor belt is prolonged. The cutting table 3 is removably connected to the frame 1 for facilitating reparation and replacement of the parts.

The paper on the cutting table 3 is conveyed to the receiving hopper 4 by the conveyor belt, and the upper surface of the receiving hopper 4 is inclined downward toward a discharge direction, so as to slip the paper in the receiving hopper 4. A separate receiving rack may be provided on the front side of the receiving hopper 4 to collect the paper slipped from the receiving hopper 4. The receiving hopper 4 is provided with two discharge baffles 41 for limiting the discharge position of the paper. The bottom of the discharge baffle 41 is magnetically connected to the receiving hopper 4, and the discharge baffle 41 may be arbitrarily moved on the receiving hopper 4, so that the loading position of the discharge baffle 41 may be adjusted according to the paper discharge position to ensure the limiting effect. In this embodiment, the discharge baffle 41 is disposed at left and right sides of the receiving hopper 4, and the rear portion of the discharge baffle 41 has an inclined guiding surface; the inclined directions of the guiding surface for the discharge baffle 41 at both sides are opposite to constitute a guiding structure with an opening that becomes gradually smaller, which facilitates the receiving hopper 4 to collect papers loaded from different positions.

The left and right sides of the frame 1 are provided with linear guide rails 51; both sides of the crossbeam 5 are connected to the linear guide rails 51, and the crossbeam 5 may be moved back and forth along the linear guide rails 51. A machine head moving mechanism is provided in the crossbeam 5 for driving the machine head 6 to move left and right on the crossbeam 5. Through the movement of the crossbeam 5 and the machine head 6, the cutting components may be moved to any positions of the cutting table 3 to achieve any cutting requirements.

As shown in combination of FIG. 3 through FIG. 13, the machine head 6 includes a connecting plate 601, a fixing plate 602, a cutter holder 603, a cutting component, a machine head lifting mechanism and a machine head rotating mechanism. The connecting plate 601 is assembled with the crossbeam 5 to be moved on the crossbeam 5, and the fixing plate 602 is fixedly connected to the connecting plate 601. The fixing plate 602 is provided with a cutter holder guiding rod 605, the cutter holder 603 is connected to the cutter holder guiding rod 605 to be moved up and down along the cutter holder guiding rod 605, and the cutting component is mounted on the cutter holder 603. Specifically, the cutting component includes a plurality of cutter head assemblies, the cutter holder 603 is provided with a cutter seat 604, and the cutter head assemblies are mounted on corresponding cutter seats 604. The machine head lifting mechanism is connected to the cutter holder 603 for driving the cutter holder 603 to move up and down, and the machine head rotating mechanism is connected to the cutter head assemblies for driving each of the cutter head assemblies to rotate. Each of the cutter head assemblies is controlled in the rotation angle by the machine head rotating mechanism, and each of the cutter head assemblies has a controllable rotation angle. When the machine head 6 performs cutting, the cutter head assembly that needs to perform cutting operation is moved to an appropriate height by the machine head lifting mechanism, the cutter head assembly is controlled to rotate by the machine head rotating mechanism, and the angle of the cutter head assembly is adjusted at any time according to a defined cutting line. The cutting line cut by the machine head 6 has no flaws and completely coincides with the defined cutting line to ensure the integrity of the cutting pattern.

The cutter holder 603 is provided with a positioning mechanism for determining the cutting position and ensuring the cutting precision. The positioning mechanism includes a positioning camera 671 and a flashlight 672, wherein the positioning camera 671 may position a cutting portion of the paper to make the cutting component perform cutting operation according to a defined walking path, and the flashlight 672 provides illumination and is mounted inclinedly on the cutter holder 603 to prevent light reflection.

Figure 3:
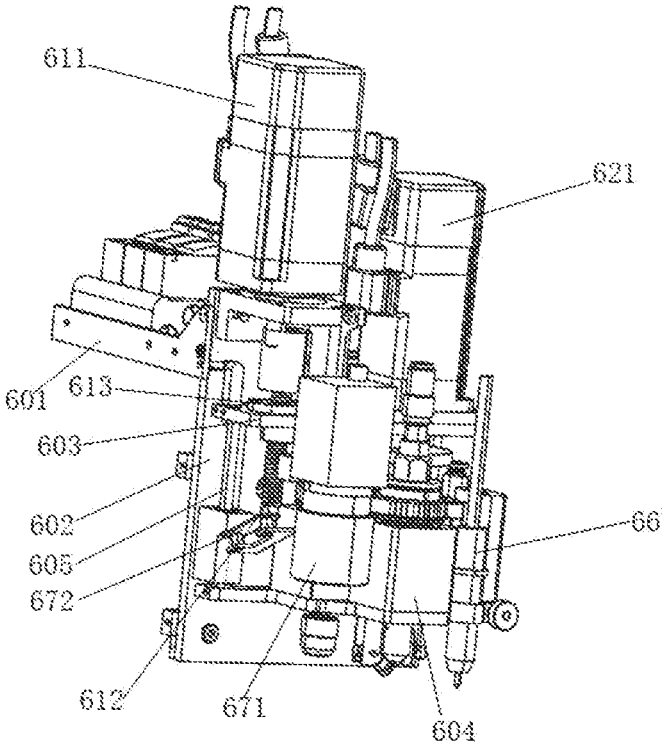
FIG. 3 is a first structural view of a machine head of a paper feeding and cutting machine of the present invention.
Figure 4:
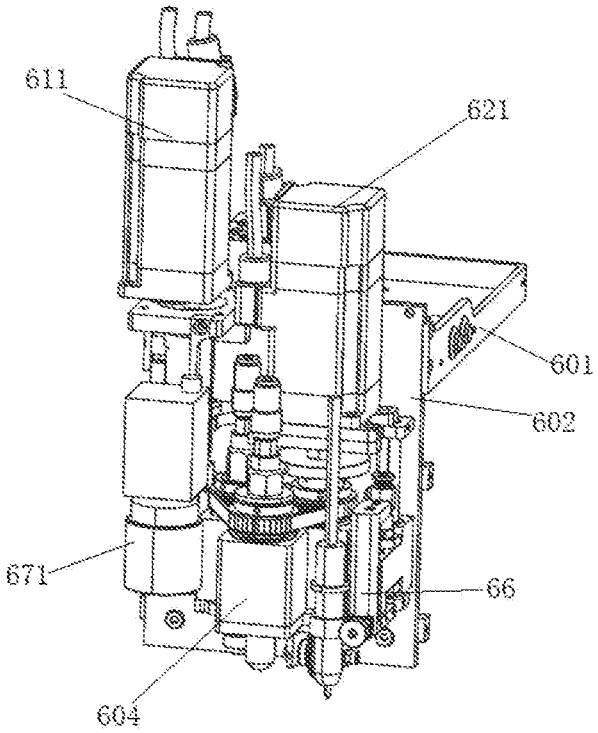
FIG. 4 is a second structural view of a machine head of a paper feeding and cutting machine of the present invention.
Figure 5:
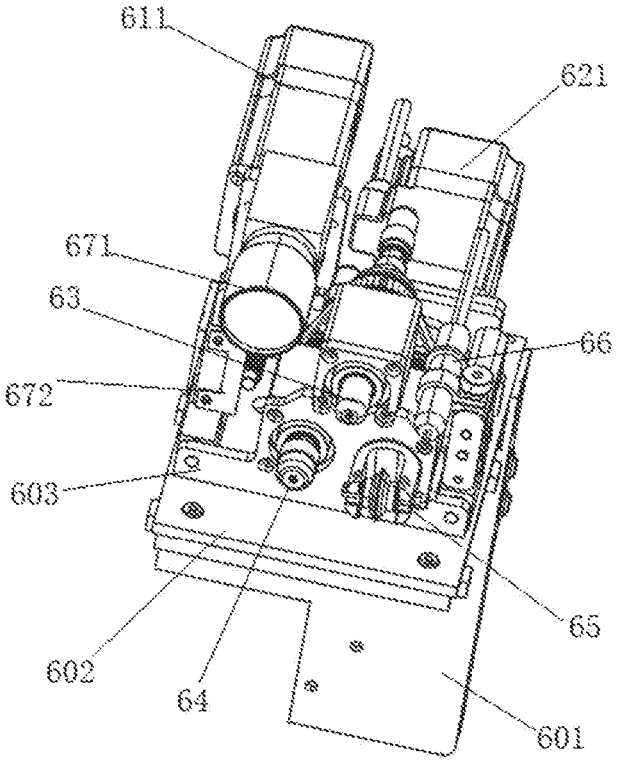
FIG. 5 is a third structural view of a machine head of a paper feeding and cutting machine of the present invention.

As shown in combination of FIG. 3, the machine head lifting mechanism includes a lifting motor 611, a screw rod 612 and a lifting screw nut 613, wherein a motor shaft of the lifting motor 611 is connected to the screw rod 612, the lifting screw nut 613 is mounted on the screw rod 612, and the lifting screw nut 613 is fixedly connected to the cutter holder 603. When the lifting motor 611 is in operation, the screw rod 612 is driven to rotate, and the lifting screw nut 613 moves up and down along the screw rod 612, and when the lifting screw nut 613 moves, the cutter holder 603 moves up and down along the cutter holder guiding rod 605. The machine head lifting mechanism may control the movement of the cutter holder 603 to adjust the height of the cutter holder 603, that is, the height of the cutter head assembly may be controlled, so that a cutting portion of the cutter head assembly is in contact with the paper on the cutting table 3.

Figure 6:
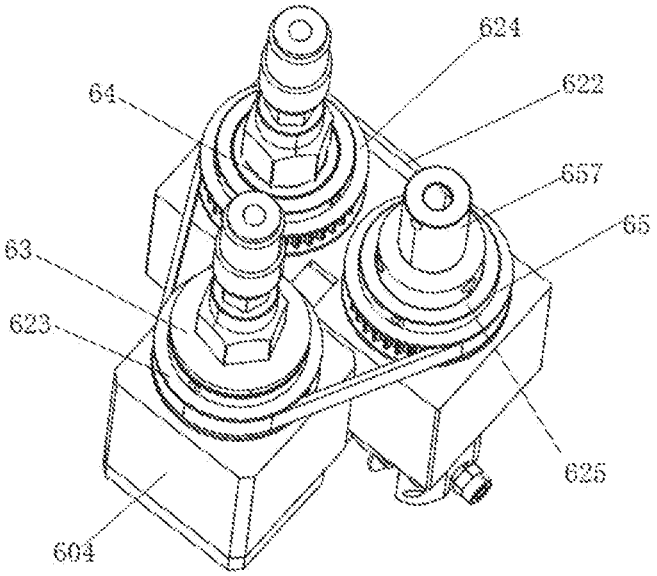
FIG. 6 is an assembly view of a cutting part of the machine head of the present invention.
Figure 7:
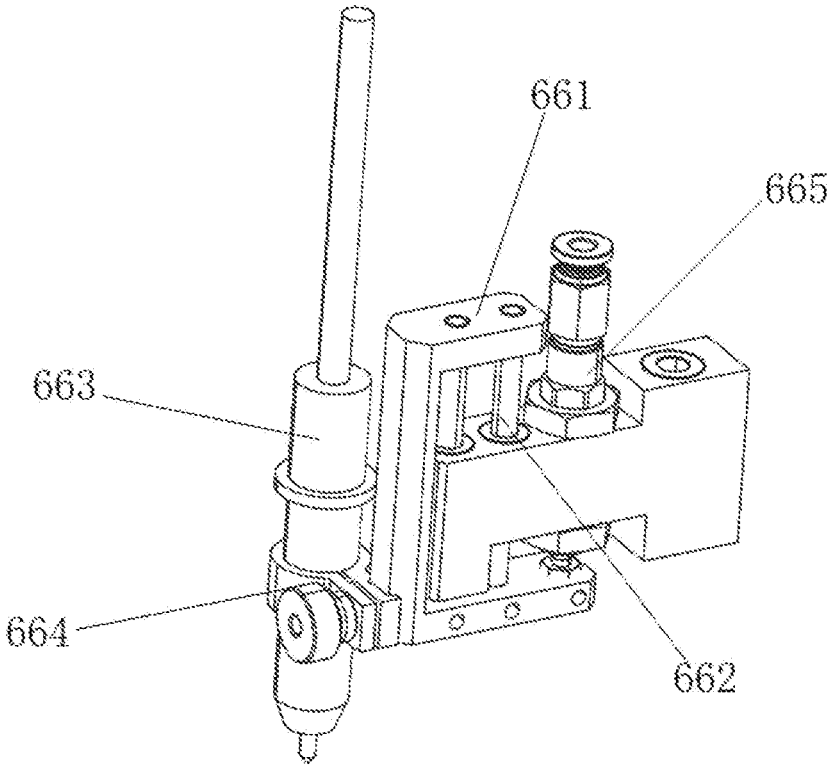
FIG. 7 is an assembly view of a marking assembly of the machine head of the present invention.

As shown in combination of FIG. 6, in this embodiment, the cutting component includes three cutter head assemblies, i.e., a full-cutting cutter head assembly 63, a half-cutting cutter head assembly 64, and a pinch roller cutter head assembly 65, respectively, wherein the full-cutting cutter head assembly 63 may completely cut through the paper, and is mainly used for paper division and cutting hollow patterns; the half-cutting cutter head 644 may not cut through the paper, but leaves a deep cut on the paper surface, which may be used for cutting self-adhesive labels, etc.; the pinch roller cutter head assembly 65 is used for pressing an indentation on the paper to facilitate folding of the paper, and is commonly used for cutting paper in a package. The machine head rotating mechanism includes a rotating motor 621, a synchronizing belt 622, and synchronizing gears, wherein the number of the synchronizing gears is the same as the number of the cutter head assemblies. The cutter head assembly has rotating sleeves mounted on the cutter seat 604 and moving relative to the cutter seat 604, and each of the synchronizing gears is respectively connected to one of the rotating sleeves to control the rotation of the corresponding cutter head assembly.

In this embodiment, the number of synchronizing gears is three, which are a first synchronizing gear 623, a second synchronizing gear 624, and a third synchronizing gear 625, respectively. The full-cutting cutter head assembly 63 includes a first rotating sleeve 632, the half-cutting cutter head assembly 64 includes a second rotating sleeve 642, and the pinch roller cutter head assembly 65 includes a third rotating sleeve 651; the first synchronizing gear 623 is connected to and synchronously moves with the first rotating sleeve 632, the second synchronizing gear 624 is connected to and synchronously moves with the second rotating sleeve 642, and the third synchronizing gear 625 is connected to and synchronously moves with the third rotating sleeve 651; the synchronizing belt 622 encloses the three synchronizing gears and acts as a transmission between the three synchronizing gears. The pinch roller cutter head assembly 65 includes a connecting shaft 657, the motor shaft of the rotating motor 621 is fixedly connected to the connecting shaft 657; when the rotating motor 621 performs a rotation, the pinch roller cutter head assembly 65 follows the rotation, and the third synchronizing gear 625 rotates to move the synchronizing belt 622, thereby driving the first synchronizing gear 623 and the second synchronizing gear 624 to rotate, then the full-cutting cutter head assembly 63 and the half-cutting cutter head assembly 64 may also follow the rotation. Therefore, in this embodiment, the third synchronizing gear 625 is a driving wheel, and the first synchronizing gear 623 and the second synchronizing gear 624 are driven wheels. In other embodiments, the motor shaft of the rotating motor 621 may be connected to any one of the cutter head assemblies, and the cutter head assembly directly connected to the rotating motor 621 rotates and then drives the other cutter head assemblies to rotate, so that the rotation angles of the plurality of cutter assemblies may be controlled by a rotating motor 621 to meet the requirements for the cutting operation.

Figure 8:
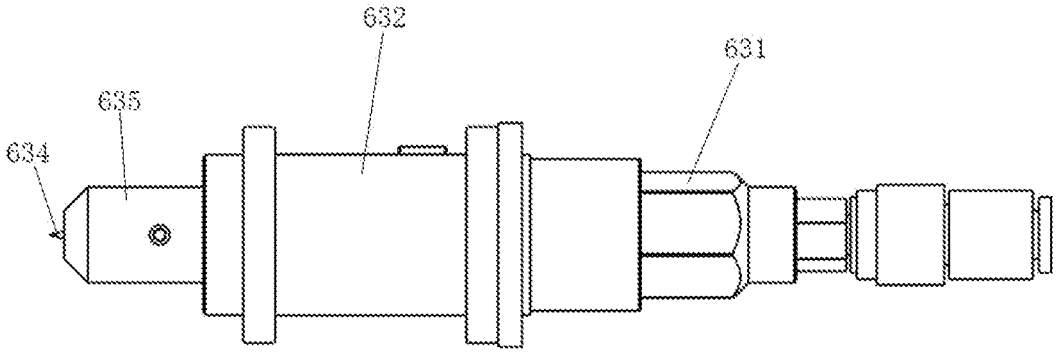
FIG. 8 is a structural view of a full-cutting cutter head assembly of the machine head of the present invention.
Figure 9:
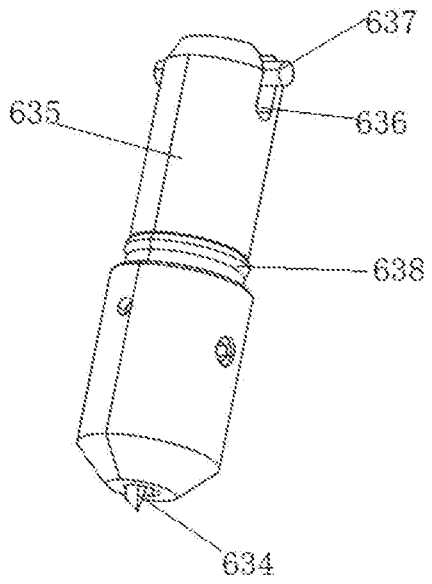
FIG. 9 is an assembly view of a full-cutting cutter head and a full-cutting cutter handle of the machine head of the present invention.

As shown in combination of FIG. 8 and FIG. 9, the full-cutting cutter head assembly 63 includes a first rotating sleeve 632, a first cutter sleeve, a full-cutting cutter head 634 and a full-cutting cutter handle 635, wherein the first cutter sleeve is fixedly mounted in the first rotating sleeve 632, and the full-cutting cutter head 634 is mounted on the full-cutting cutter handle 635; an engagement slot is disposed on the full-cutting cutter handle 635, and a first sealing ring 638 is engaged in the engagement slot; the full-cutting cutter handle 635 is inserted into the first cutter sleeve, and the first sealing ring 638 is engaged with a fitting groove of the first cutter sleeve, so that the full-cutting cutter handle 635 is fixed in the first cutter sleeve, and the full-cutting cutter handle 635 is reliably connected to the first cutter sleeve and is easy to disassemble. A first positioning groove 636 is disposed in the tail of the full-cutting cutter handle 635, a first positioning pin 637 enters the positioning groove, and both ends of the first positioning pin 637 are fixed on the first cutter sleeve, so that the full-cutting cutter handle 635 may not rotate freely, and the rotation angle of the full-cutting cutter head 634 is controlled by the machine head rotating mechanism. A cutter tip of the full-cutting cutter head 634 is located on a rotation axis of the full-cutting cutter head assembly 63, reducing the rotational resistance experienced by the full-cutting cutter head 634 when cutting, and avoiding damage to the cutter head.

Figure 10:
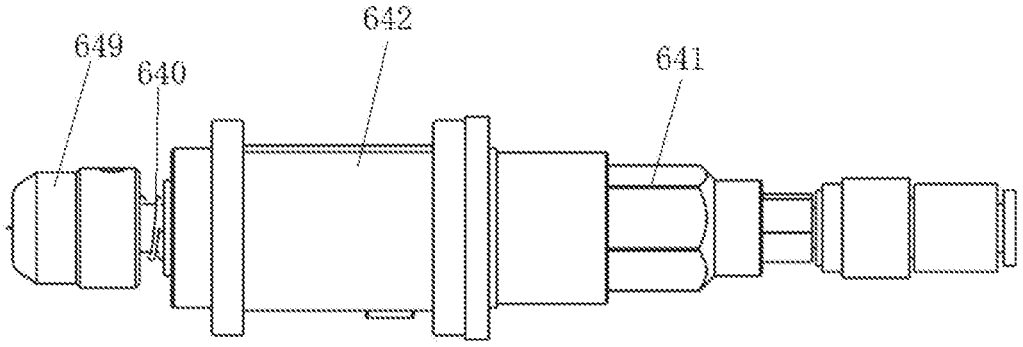
FIG. 10 is a structural view of a half-cutting cutter head assembly of the machine head of the present invention.
Figure 11:
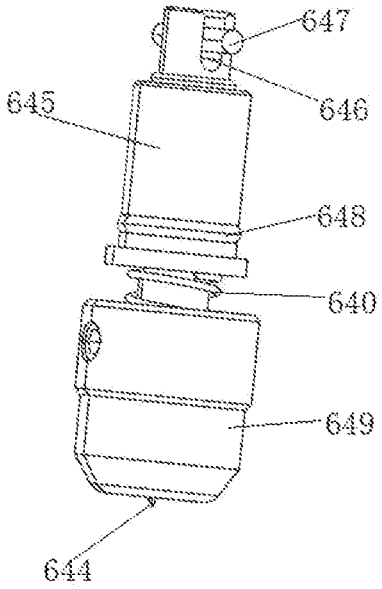
FIG. 11 is an assembly view of a half-cutting cutter head and a half-cutting cutter handle of the machine head of the present invention.

As shown in combination of FIG. 10 and FIG. 11, the half-cutting cutter head assembly 64 includes a second rotating sleeve 642, a second cutter sleeve, a half-cutting cutter head 644, a half-cutting cutter handle 645, a cutter head end cap 649 and a cutter head spring 640, wherein the second cutter sleeve is fixedly mounted in the second rotating sleeve 642, and the half-cutting cutter head 644 is mounted on the half-cutting cutter handle 645; an engagement slot is disposed on the half-cutting cutter handle 645, and a second sealing ring 648 is engaged in the engagement slot; the half-cutting cutter handle 645 is inserted into the second cutter sleeve, and the second sealing ring 648 is engaged with a fitting groove of the second cutter sleeve, so that the half-cutting cutter handle 645 is fixed in the second cutter sleeve, and the half-cutting cutter handle 645 is reliably connected to the second cutter sleeve and is easy to disassemble. The cutter head end cap 649 is sleeved in front of the half-cutting cutter head 644 for controlling the cutting depth of the half-cutting cutter head 644 that is a portion exposing the cutter head end cap 649, and the cutter head spring 640 is sleeved outside the half-cutting cutter handle 645 with one end abutting against the cutter head end cap 649 so as to control the exposing length of the half-cutting cutter head 644, i.e., controlling the cutting depth to prevent cutting through. A second positioning groove 646 is disposed in the tail of the half-cutting cutter handle 645, a second positioning pin 647 enters the positioning groove, and both ends of the second positioning pin 647 are fixed on the second cutter sleeve, so that the half-cutting cutter handle 645 may not rotate freely, and the rotation angle of the half-cutting cutter head 644 is controlled by the machine head rotating mechanism. A cutter tip of the half-cutting cutter head 644 is located on a rotation axis of the half-cutting cutter head assembly 64, reducing the rotational resistance experienced by the half-cutting cutter head 644 when cutting, and avoiding damage to the cutter head.

Figure 12:
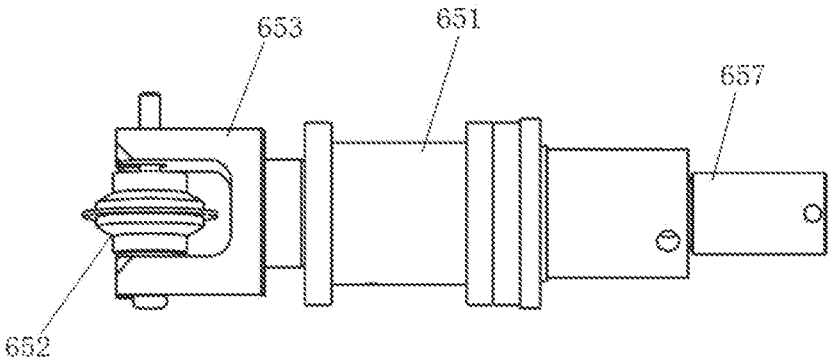
FIG. 12 is a structural view of a pinch roller cutter head assembly of the machine head of the present invention.
Figure 13:
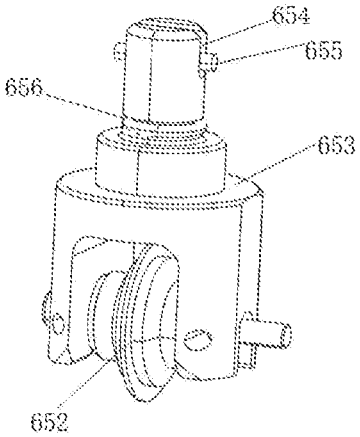
FIG. 13 is an assembly view of a pinch roller cutter head and a pinch roller cutter handle of the machine head of the present invention.

As shown in combination of FIG. 12 and FIG. 13, the pinch roller cutter head assembly 65 includes a third rotating sleeve 651, a pinch roller cutter head 652 and a pinch roller cutter handle 653, wherein the pinch roller cutter head 652 is mounted on the pinch roller cutter handle 653; an engagement slot is disposed on the pinch roller cutter handle 653, and a third sealing ring 656 is engaged in the engagement slot; the pinch roller cutter handle 653 is inserted into the third rotating sleeve 651, and the third sealing ring 656 is engaged with a fitting groove of the third rotating sleeve 651, so that the pinch roller cutter handle 653 is fixed in the third rotating sleeve 651, and the pinch roller cutter handle 653 is reliably connected to the third rotating sleeve 651 and is easy to disassemble. A third positioning groove 654 is disposed in the tail of the pinch roller cutter handle 653, a third positioning pin 655 enters the positioning groove, and both ends of the third positioning pin 655 are fixed on the third rotating sleeve 651, so that the pinch roller cutter handle 653 may not rotate freely, and the rotation angle of the pinch roller cutter head 652 is controlled by the machine head rotating mechanism.

The cutter heads of the three cutter head assemblies are not free to rotate, and the rotation angle of each of the cutter heads may be controlled by the machine head rotating mechanism, so that the cutting may be completed according to the setting, and the cutting line is free from defects, thereby improving the cutting precision.

When the paper-feeding cutting machine performs cutting operation, only one cutter head assembly operates at a time, so that it is necessary to set each cutter head assembly at different heights, so as to prevent the plurality of cutter heads from performing cutting at the same time and destroying the paper. In this embodiment, the height of the pinch roller cutter head assembly 65 is the lowest, and the full-cutting cutter head assembly 63 and the half-cutting cutter head assembly 64 are positioned higher; the full-cutting cutter head assembly 63 has a first air cylinder 631 for adjusting the height of the full-cutting cutter head 634, and the half-cutting cutter head assembly 64 has a second air cylinder 641 for adjusting the height of the half-cutting cutter head 644. When the pinch roller cutter head assembly 65 is required to perform cutting, the first air cylinder 631 and the second air cylinder 641 is in a retracted state, and the machine head lifting mechanism controls the cutter holder 603 to lift, so that the pinch roller cutter head 652 is in contact with the paper. At this time, the full-cutting cutter head 634 and the half-cutting cutter head 644 may not in contact with the paper, the crossbeam 5 and the machine head 6 move to control the cutting position, and the machine head rotating mechanism controls the rotation angle of the pinch roller cutter head 652, then an indentation tangent may be made on the paper according to the setting. When the full-cutting cutter head 634 is required to perform cutting, the first air cylinder 631 is extended such that the height of the full-cutting cutter head 634 is lower than the height of the pinch roller cutter head 654 and the height of the half-cutting cutter head 644; the machine head lifting mechanism adjusts the position of the cutter holder 603, and the cutter tip of the full-cutting cutter head 634 contacts the paper to complete the cutting by controlling the movement of the machine head 6 and the rotation of the full-cutting cutter head 634. When the half-cutting cutter head 644 is required to perform cutting, the first air cylinder 631 is retracted and the second air cylinder 641 is extended such that the height of the half-cutting cutter head 644 is lower than the height of the pinch roller cutter head 654 and the height of the full-cutting cutter head 634; the machine head lifting mechanism adjusts the position of the cutter holder 603, and the cutter tip of the half-cutting cutter head 644 contacts the paper to complete the cutting by controlling the movement of the machine head 6 and the rotation of the half-cutting cutter head 644.

As shown in combination of FIG. 3, FIG. 4, FIG. 5 and FIG. 7, the cutter holder 603 is further provided with a marking assembly 66 for marking on the paper. The marking assembly 66 includes a pen seat 661, a pen seat guiding rod 662, a marker pen 663, and a third air cylinder 665, wherein the pen seat 661 is connected to the pen seat guiding rod 662 to be moved up and down along the pen seat guiding rod 662, the third air cylinder 665 is connected to the pen seat 661, the pen seat 661 is provided with a pen clip 664, and the marker pen 663 is fixed on the pen seat 661 by the pen clip 664. When the machine head 6 performs cutting, the height of the marker pen 663 is higher than that of the cutting component to prevent excess markings from existing on the paper. When marking is required, the third air cylinder 665 extends to push the pen seat 661 to move downward, a tip of the marker pen 663 is lower than the cutter head of the cutting assembly, and the machine head lifting mechanism adjusts the position of the cutter holder 603 to make the tip of the marker pen 663 contact with the paper, so that the movement of the machine head 6 leaves a mark on the paper.

The embodiment of the present invention provides a highly automated paper-feeding cutting machine, in which through the new cutting machine head, the actual cutting line is ensured to be consistent with the setting, the cut paper is complete and flawless, thereby achieving paper cutting operations with high-precision and high-efficiency, so the present invention has a good industrial promotion value.

What is claimed is:

1. A cutting machine head, comprising:

a fixing plate;

a cutter holder;

a cutting component;

a machine head lifting mechanism; and a machine head rotating mechanism;

wherein the cutter holder is mounted on the fixing plate; the machine head lifting mechanism is connected to the cutter holder, and is used to drive the cutter holder to move up and down on the fixing plate; the cutting component comprises at least two cutter head assemblies mounted on the cutter holder; the machine head rotating mechanism is connected to the cutter head assemblies for driving the cutter head assemblies to rotate;

wherein the machine head rotating mechanism comprises a rotating motor, a synchronizing belt, and a plurality of synchronizing gears; the cutter head assemblies comprise a plurality of rotating sleeves; each of the plurality of synchronizing gears are connected to each of the plurality of rotating sleeves; a motor shaft of the rotating motor is connected to one of the at least two cutter head assemblies; and the synchronizing belt connects each of the plurality of synchronizing gears.

2. The cutting machine head according to claim 1, wherein each of the cutter head assemblies comprises a cutter head, a cutter handle and a positioning pin; the cutter head is mounted on the cutter handle; a positioning groove is disposed in a tail of the cutter handle; the positioning pin enters the positioning groove; and the positioning pin rotates synchronously with the corresponding rotating sleeve.

3. The cutting machine head according to claim 2, wherein an engagement slot is disposed on the cutter handle, and a sealing ring is engaged in the engagement slot.

4. The cutting machine head according to claim 1, wherein the at least two cutter head assemblies of the cutting component comprises a full-cutting cutter head assembly, a half-cutting cutter head assembly, and a pinch roller cutter head assembly; the full-cutting cutter head assembly comprises a full-cutting cutter head; the half-cutting cutter head assembly comprises a half-cutting cutter head; and the pinch roller cutter head assembly comprises a pinch roller cutter head.

5. The cutting machine head according to claim 4, wherein the full-cutting cutter head assembly further comprises a first air cylinder for controlling a lift movement of the full-cutting cutter head; and the half-cutting cutter head assembly further comprises a second air cylinder for controlling a lift movement of the half-cutting cutter head.

6. The cutting machine head according to claim 4, wherein the pinch roller cutter head assembly further comprises a connecting shaft, the motor shaft of the rotating motor is fixedly connected to the connecting shaft; when the rotating motor performs a rotation, the pinch roller cutter head assembly follows the rotation, and a third synchronizing gear of the pinch roller cutter head assembly rotates to move the synchronizing belt, thereby driving a first synchronizing gear of the full-cutting cutter head assembly and a second synchronizing gear of the half-cutting cutter head assembly to rotate.

7. The cutting machine head according to claim 1, wherein the machine head lifting mechanism further comprises a lifting motor, a screw rod and a lifting screw nut; a motor shaft of the lifting motor is connected to the screw rod, the lifting screw nut is mounted on the screw rod, and the lifting screw nut is connected to the cutter holder.

8. The cutting machine head according to claim 1, wherein the cutter holder is further provided with a marking assembly; the marking assembly comprises a pen seat, a pen seat guiding rod, a marker pen, and a third air cylinder; the marker pen is mounted on the pen seat, the pen seat is connected to the pen seat guiding rod, the third air cylinder is connected to the pen seat for driving the pen seat to move up and down.

9. The cutting machine head according to claim 1, wherein the cutter holder is further provided with a positioning mechanism, and the positioning mechanism comprises a positioning camera and a flashlight.

10. A cutting machine, comprising:

a frame, wherein a control element of the cutting machine is mounted on the frame, and the frame is provided with a paper-loading platform, a cutting table, a receiving hopper and a crossbeam;

wherein the crossbeam is provided with a cutting machine head, the cutting machine head comprising:

a fixing plate;

a cutter holder;

a cutting component;

a machine head lifting mechanism; and a machine head rotating mechanism;

wherein the cutter holder is mounted on the fixing plate; the machine head lifting mechanism is connected to the cutter holder, and is used to drive the cutter holder to move up and down on the fixing plate; the cutting component comprises at least two cutter head assemblies mounted on the cutter holder; the machine head rotating mechanism is connected to the cutter head assemblies for driving the cutter head assemblies to rotate;

wherein the machine head rotating mechanism comprises a rotating motor, a synchronizing belt, and a plurality of synchronizing gears; the cutter head assemblies comprise a plurality of rotating sleeves; each of the plurality of synchronizing gears are connected to each of the plurality of rotating sleeves; a motor shaft of the rotating motor is connected to one of the at least two cutter head assemblies; and the synchronizing belt connects each of the plurality of synchronizing gears.

11. The cutting machine according to claim 10, wherein each of the cutter head assemblies comprises a cutter head, a cutter handle and a positioning pin; the cutter head is mounted on the cutter handle; a positioning groove is disposed in a tail of the cutter handle; the positioning pin enters the positioning groove; and the positioning pin rotates synchronously with the corresponding rotating sleeve.

12. The cutting machine according to claim 11, wherein an engagement slot is disposed on the cutter handle, and a sealing ring is engaged in the engagement slot.

13. The cutting machine according to claim 10, wherein the at least two cutter head assemblies of the cutting component comprises a full-cutting cutter head assembly, a half-cutting cutter head assembly, and a pinch roller cutter head assembly; the full-cutting cutter head assembly comprises a full-cutting cutter head; the half-cutting cutter head assembly comprises a half-cutting cutter head; and the pinch roller cutter head assembly comprises a pinch roller cutter head.

14. The cutting machine according to claim 13, wherein the full-cutting cutter head assembly further comprises a first air cylinder for controlling a lift movement of the full-cutting cutter head; and the half-cutting cutter head assembly further comprises a second air cylinder for controlling a lift movement of the half-cutting cutter head.

15. The cutting machine according to claim 13, wherein the pinch roller cutter head assembly further comprises a connecting shaft, the motor shaft of the rotating motor is fixedly connected to the connecting shaft; when the rotating motor performs a rotation, the pinch roller cutter head assembly follows the rotation, and a third synchronizing gear of the pinch roller cutter head assembly rotates to move the synchronizing belt, thereby driving a first synchronizing gear of the full-cutting cutter head assembly and a second synchronizing gear of the half-cutting cutter head assembly to rotate.

16. The cutting machine according to claim 10, wherein the machine head lifting mechanism further comprises a lifting motor, a screw rod and a lifting screw nut; a motor shaft of the lifting motor is connected to the screw rod, the lifting screw nut is mounted on the screw rod, and the lifting screw nut is connected to the cutter holder.

17. The cutting machine according to claim 10, wherein the cutter holder is further provided with a marking assembly; the marking assembly comprises a pen seat, a pen seat guiding rod, a marker pen, and a third air cylinder; the marker pen is mounted on the pen seat, the pen seat is connected to the pen seat guiding rod, the third air cylinder is connected to the pen seat for driving the pen seat to move up and down.

18. The cutting machine according to claim 10, wherein the cutter holder is further provided with a positioning mechanism, and the positioning mechanism comprises a positioning camera and a flashlight.

* * * * *